United States Patent [19]

Matsunaga et al.

[11] Patent Number: 4,646,052

[45] Date of Patent: Feb. 24, 1987

[54] SLOW BLOW FUSE

[75] Inventors: Katsumi Matsunaga; Yoshitsugu Tsuji, both of Mie, Japan

[73] Assignee: Sumitomo Wiring System, Ltd., Nie, Japan

[21] Appl. No.: 813,076

[22] Filed: Dec. 24, 1985

[51] Int. Cl.[4] ..... H01H 85/04

[52] U.S. Cl. ..... 337/166; 337/163

[58] Field of Search ..... 337/163, 164, 165, 166, 337/162, 296, 295

[56] References Cited

U.S. PATENT DOCUMENTS 2,055,866 9/1936 Jung et al. ..... 337/166

4,430,633 2/1984 Ebi ..... 337/166

*Primary Examiner*—Harold Broome

*Attorney, Agent, or Firm*—Wenderoth, Lind & Ponack

[57] ABSTRACT

A slow blow fuse has a fuse element section and a pair of electrical terminals integrally formed with the opposite ends of the fuse element section. The fuse element section and the electrical terminals are formed of a high melting point metal and heat accumulators formed of aluminum are secured to the opposite ends of the fuse element section in heat transfer relationship therewith.

4 Claims, 3 Drawing Figures

Fig. 1
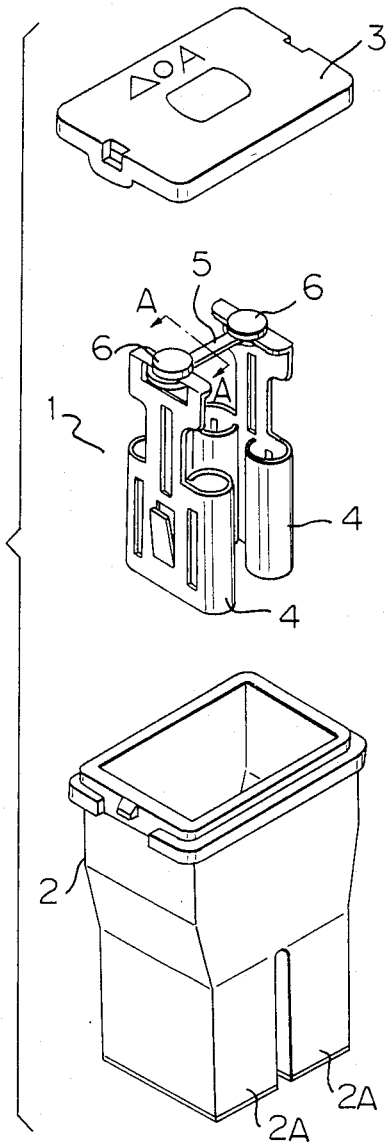
Fig. 2a
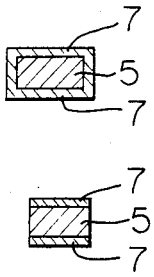
Fig. 2b
Fig. 3
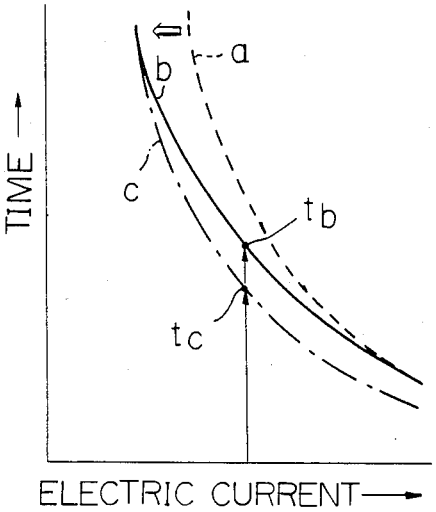

SLOW BLOW FUSE

BACKGROUND OF THE INVENTION

A slow blow fuse having in time lag characteristic in that the fuse has a low critical current for blowing at a low current area and does not blow at instantaneous overcurrent is disclosed in, for example, Japanese Utility Model Application Publicly Laid-Open No. 20254/1981. In the fuse of this U.M. application, the fuse element formed of a metal having a low melting point is held in an intermediate area of the fuse element section formed of a metal having a high melting point. However, this prior art fuse presents problems in that the blowing characteristic of the fuse is dull in the low current area which is beyond continuous permissive currents and that the fuse blows relatively easily at instantaneous overcurrent flows. Japanese Utility Model Application Publicly Laid-Open No. 66844/1984 proposes a slow blow fuse which is improved over the above-mentioned prior art. In this improved fuse, the fuse element section is formed of bimetal and a heat accumulator or accumulators formed of a metal having a low melting point are held in an intermediate area of the bimetal fuse element section. However, this fuse presents problems related to performance and manufacture. That is, since the heat accumulator or accumulators are formed of a low melting point metal such as tin or lead, and a diffusion phenomenon occurs at relatively low temperatures of generated heat, when the fuse is installed in high temperature environments and is used in an application condition in which heat is generated due to the intermittent flow of normal current, the diffusion occurs progressively which results in shortening of the service life.

Also the slow blow fuse comprising the bimetal fuse element section essentially requires a bimetal jointing step which makes the manufacture of the fuse complicated and expensive. Furthermore, since heat generation and cooling alternate with each other as intermittent current flows, the fuse has the disadvantage that the joining portions of the bimetal fuse element section and of the terminals tend to suffer from insufficient contact and, thus, the performance of the fuse may vary after use over a long period of time.

Furthermore, since the fuse element section of the slow blow fuses referred to above are housed in a protective case formed of plastic, there is a disadvantage in that the plastic case melts when high temperatures are generated in the fuse element section.

SUMMARY OF THE INVENTION

The purpose of the present invention is to eliminate the disadvantages inherent in the prior art fuses referred to above.

In order to attain this object, the present invention provide a slow blow fuse in which, by the use of a low radiation rate metal such as aluminium as the material for the heat accumulator, even when a metal having a high melting point such as copper alloy is used as the material for the fuse element section, the slow blow fuse can exhibit a satisfactory time lag characteristic for blowing and further displays advantages in terms of durability and cost.

Another object of the present invention is to provide a slow blow fuse in which the peripheral surface of the fuse element section is covered wholly or substantially with a lamina or laminas formed of a metal having a low rate of radiation whereby the time lag for blowing can further be extended and the case in which the fuse element section is received is protected against melting even when high temperatures are generated in the fuse element section.

Many other advantages, features and additional objects of the present invention will become apparent to persons skilled in the art upon making reference to the detailed description and the accompanying drawings in which preferred embodiments of the present invention are shown by way of illustrative example.

BRIEF DESCRIPTION OF THE DRAWING

FIG. 1 is an exploded perspective view of one embodiment of the slow blow fuse according to the present invention;

FIGS. 2(*a*) and 2(*b*) are cross-sectional views taken along the line A—A of FIG. 1; and FIG. 3 is a diagram showing the blowing characteristic of the embodiment shown in FIG. 1.

PREFERRED EMBODIMENT OF THE INVENTION

The present invention will now be described referring to the accompanying drawings in which one preferred embodiment of the slow blow fuse according to the present invention is shown. In FIG. 1, reference numeral 1 denotes a charge member, reference numeral 2 denotes a case formed of insulation material such as synthetic resin and receiving the charge member 1 therein and reference numeral 3 denotes a lid adapted to be fitted on the opening in the case 2.

The charge member 1 comprises a pair of electrical terminals 4,4, a fuse element section 5 and heat accumulators 6,6. The electrical terminals 4,4 and fuse element section 5 are integrally formed by pressing a flat sheet of a metal having a high melting point such as a copper alloy, for example, and the heat accumulators 6,6 which are in the form of a rivet and secured to the terminals 4,4 and fuse element section 5 by fitting the heat accumulators into aligned holes (not shown) formed in the joining portions between terminals and fuse element section 4,4 and 5 and then elongating the heat accumulators in the holes under pressure.

The fuse element section 5 is in the form of a narrow straight copper alloy piece having a suitable length and the electrical terminals 4,4 have a B-shaped cross section and extend parallel and in a facing relationship with each other. The fuse element section 5 extends between and bridges the electrical terminals 4,4.

The rivet-shaped heat accumulator is formed of aluminium which has a low radiation rate and a melting point lower than that of the copper alloy of which the electrical terminals 4,4 and fuse element section 5 are formed.

As shown, the charge member 1 is held in position within the case 2 by placing the electrical terminals 4,4 into the respectively associated compartments 2A,2A of the casing 2 with the electrical terminals 4,4 disposed in front. The fuse element section 5 disposed at the rear and the lid 3 is then fitted onto the case 2 so as to close the opening in the case and electrically insulate the charge member 1 and thereby complete the slow blow fuse.

When flat male terminals connected to the ends of electrical wires are inserted into the terminal inlets of the terminal receiving compartments 2A,2A until the male terminals fit the respectively associated electrical terminals 2A,2A in the compartments, the fuse element section 5 is interposed in an electrical circuit which includes the electrical wires.

In the above-described slow blow fuse, since the radiation rate of the heat accumulator 6 is low, heat dissipation is relatively less at low current flow and, thus, heat migration from the fuse element section 5 is inhibited. As a result, the slow blow fuse exhibits a sufficiently rapid blowing performance at low current flow.

On the other hand, since aluminium is light in weight, even if the amount of accumulation heat of the heat accumulator 6 is increased by constructing the heat accumulator to have a large capacity, this increase does not add excessive load to the fuse element section 5 and thus the slow blow fuse can exhibit a sufficiently slow blow characteristic even when instantaneously large current are applied.

And, since aluminium is a metal having a melting point higher than those of tin and lead, the diffusion proceeds slowly even when the slow blow fuse is placed in a high temperature environment and thus the durability of the slow blow fuse is improved.

Also, since the radiation rate of the heat accumulator 6 is low, even when the heat accumulator 6 is heated to a high temperature, it is capable of preventing the heat from melting the plastic case. Further, since aluminum is light in weight and is excellent in workability, when the heat accumulator 6 is attached on the terminal 4 and fuse element section 5, it does not add any substantial load burden to the fuse element section 5, which is usually thin in size and mechanically weak, and this makes production of the slow blow fuse easy, thus providing the products with stable and uniform qualities.

FIGS. 2(*a*) and 2(*b*) are cross-sectional views taken along the line A—A of FIG. 1 and show two alternate arrangements of the fuse element section 5. The whole or a substantial portion of the fuse element section 5 is covered by a metal lamina or laminas 7 formed of a narrow metal piece having a high melting point such as copper alloy. The lamina 7 is formed of a metal having a radiation rate lower than that of the material of the fuse element section and terminals such as silver or nickel. The lamina 7 is plated or vapour deposited on the fuse element section 5 and has a thickness of several microns so as to cover the whole peripheral surface of the section 5 as shown in FIG. 2(*a*) or each of the opposite sides of the section 5 as shown in FIG. 2(*b*).

The means for forming the lamina or laminas 7 is not limited to plating or vapour-deposition, but may also include cladding comprising a combination of a high melting point metal and a low radiation rate metal having a very small thickness.

And it is, of course, within the scope of the present invention for a thin foil of metal exhibiting a low radiation rate to be applied to the fuse element section 5 as and when required.

By covering the peripheral surface of the fuse element section 5 with the lamina 7 or laminas 7 of a metal having a radiation rate lower than that of the metal of the fuse element section 5, as is apparent from the Stefan-Boltzman Law, that is:

$$q = \epsilon \cdot a \cdot T^4 \qquad \text{(A)}$$

wherein q: amount of radiation heat $\epsilon$: radiation rate (blackness)

a: Stefan-Boltzman constant

T: surface temperature difference

S: surface area, since the amount of radiation heat (q) is reduced as a matter of course when radiation rate ($\epsilon$) is reduced, it is possible to restrain the dissipation of heat generated in the fuse element section 5 into the exterior of the section.

Further, the following formula is established by the energy conservation law:

(heat accumulation amount in the element)=
(heat generation amount in the element)−
(amount of heat transfer to the element end)−
(amount of heat dissipation to the air)−
(amount of radiant heat) . . . (B)

From the above-mentioned formula (B), it is apparent that when the amount of radiant heat is reduced, the heat accumulation amount in the element increases correspondingly and the temperature of the element also rises correspondingly.

Since $q \alpha T^4$ as known from the formula (A), the greater the surface temperature difference (T) is, the greater the variation in amount of radiant heat and, thus, the degree of reduction in the amount of radiant heat due to the reduction in radiation rate is great in the blowing area where the element is maintained at high temperatures for long periods of time. That is, when the radiation rate is small, the blowing characteristic will not vary substantially for a short time blowing area, but for a long time blowing area, the temperature of the element rises easily (the element easily becomes ready for blowing).

The phenomena stated above are shown in FIG. 3 in which, when the fuse element section 5 is not covered by the lamina or laminas 7, the blowing characteristic of the element is as shown by the broken curve (a), whereas when the fuse element 5 is covered by the lamina or laminas 7, the radiation rate of which is lower than that of the fuse element, the blowing characteristic of the element for a long time blowing area shifts in the direction of the arrow shown in FIG. 3 thereby changing into the characteristic shown by the solid curve (b) therein.

In short, the covering of the fuse element section 5 with the lamina or laminas 7 of lower radiation rate reduces the rated capacity of the fuse element section.

In order to evaluate the effect on the time lag for blowing of the fuse element by the provision of the covering formed having a the lamina or laminas of lower radiation rate, when one observes the blowing characteristic of the fuse element having the same capacity in long time blowing area as that of the fuse element having the blowing characteristic (b), but not the lamina covering, the blowing characteristic of its fuse element is seen to be as shown by the one-dot-chain curve (c) and, thus, it is apparent that for the same current, the time lag for blowing (tb) of the curve (b) is greater than the time lag for blowing (tc) of the curve (c).

As demonstrated hereinabove, by the provision of the lamina covering the fuse element section, a slow blow fuse having a further extended time lag for blowing can be obtained.

Furthermore, even when the fuse element generates heat at high temperatures, the lamina or laminas 7 of lower radiation rate maintains the interior of the case 2 at low temperatures thereby protecting the case against melting.

Thus, in accordance with the invention, a slow blow fuse which can exhibit a sufficient time lag characteristic for blowing and has advantages in terms of durability and manufacturing cost is obtained.

What is claimed is:

1. A slow blow fuse comprising:

a fuse element section having opposite ends;

a pair of electrical terminals each of which is integrally formed with a respective one of said opposite ends of said fuse element section, said fuse element section and electrical terminals comprised of a metal having a high melting point; and a heat accumulator secured to each of said opposite ends of said fuse element section in a heat transfer relationship therewith for absorbing heat at said opposite ends of said fuse element, said heat accumulators being aluminum.

2. The slow blow fuse as claimed in claim 1 wherein, said fuse element section has a lamina means covering a substantial part of the periphery thereof, said lamina means comprised of a metal having a radiation rate which is lower than the radiation rate of the metal comprising said fuse element section.

3. The slow blow fuse as claimed in claim 1 and further comprising, a plastic case for receiving said fuse element section.

4. The slow blow fuse as claimed in claim 2 and further comprising, a plastic case for receiving said fuse element section.

* * * * *